US009021974B1

(12) United States Patent
Barker, IV et al.

(10) Patent No.: US 9,021,974 B1
(45) Date of Patent: May 5, 2015

(54) CLEAT DECK

(75) Inventors: B. Devereaux Barker, IV, Newport, RI (US); Kenneth J. Kirkland, Millburn, NJ (US); Diana Russell, Oyster Bay, NY (US)

(73) Assignee: Wing Systems Associates, Ltd., Oyster Bay, NY (US)

( * ) Notice: Subject to any disclaimer, the term of this patent is extended or adjusted under 35 U.S.C. 154(b) by 664 days.

(21) Appl. No.: 13/408,568

(22) Filed: Feb. 29, 2012

Related U.S. Application Data

(60) Provisional application No. 61/447,923, filed on Mar. 1, 2011.

(51) Int. Cl.
*B63B 21/08* (2006.01)
*B63B 21/04* (2006.01)

(52) U.S. Cl.
CPC ..... *B63B 21/08* (2013.01); *B63B 21/045* (2013.01)

(58) Field of Classification Search
CPC ..... B63B 21/045; B63B 21/04
USPC ..... 114/218, 199, 200; 405/207, 223.1
See application file for complete search history.

(56) References Cited

U.S. PATENT DOCUMENTS

| | | | | |
|---|---|---|---|---|
| 3,747,554 | A * | 7/1973 | Allen | 114/218 |
| 3,815,538 | A * | 6/1974 | Jurgich | 114/218 |
| 7,302,901 | B1 * | 12/2007 | Meyer et al. | 114/218 |
| 2002/0170480 | A1 * | 11/2002 | Pape et al. | 114/218 |
| 2004/0035348 | A1 * | 2/2004 | Lob et al. | 114/219 |
| 2004/0187757 | A1 * | 9/2004 | Siewert et al. | 114/218 |

* cited by examiner

*Primary Examiner* — Lars A Olson
*Assistant Examiner* — Jovon Hayes
(74) *Attorney, Agent, or Firm* — Timothy J. Klima; Shuttleworth & Ingersoll, PLC

(57) ABSTRACT

A cleat deck includes a body for attachment to a tubular body and a platform attached to the body and having a face for supporting a cleat. A fairlead extends upward and rearward from the face such that the fairlead extends rearward of an adjacent portion of the body to extend into an interior of the tubular body, through a slot in the tubular body. The fairlead has a surface configured for guiding a line between an interior and an exterior of the tubular body.

20 Claims, 2 Drawing Sheets

CLEAT DECK

This application claims priority to U.S. Provisional Patent Application 61/447,923 filed Mar. 1, 2011, the entirety of which is incorporated by reference herein.

BACKGROUND

On sailing dinghies and larger sailboats, typical internal halyard fastening arrangements comprise an exit box in the mast, a frame around a hole or slot in the mast with a sheave rotating around an axis or pin, and a cleat or jam cleat on the deck or on a platform.

BRIEF SUMMARY

A cleat deck according to the present invention includes a body for attachment to a tubular body and a platform attached to the body and having a face for supporting a cleat. A fairlead extends upward and rearward from the face such that the fairlead extends rearward of an adjacent portion of the body to extend into an interior of the tubular body, through a slot in the tubular body. The fairlead has a surface configured for guiding a line between an interior and an exterior of the tubular body.

The invention will be described in further detail below in conjunction with the attached Figures, where like reference numerals indicate like components.

DETAILED DESCRIPTION

Figure 2:
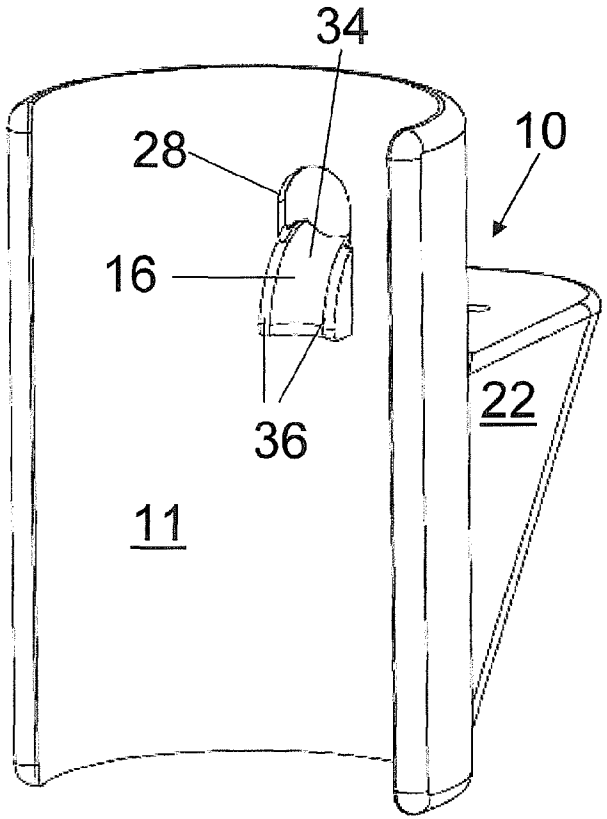
FIG. 2 shows a rear perspective view of the cleat deck of FIG. 1.
Figure 1:
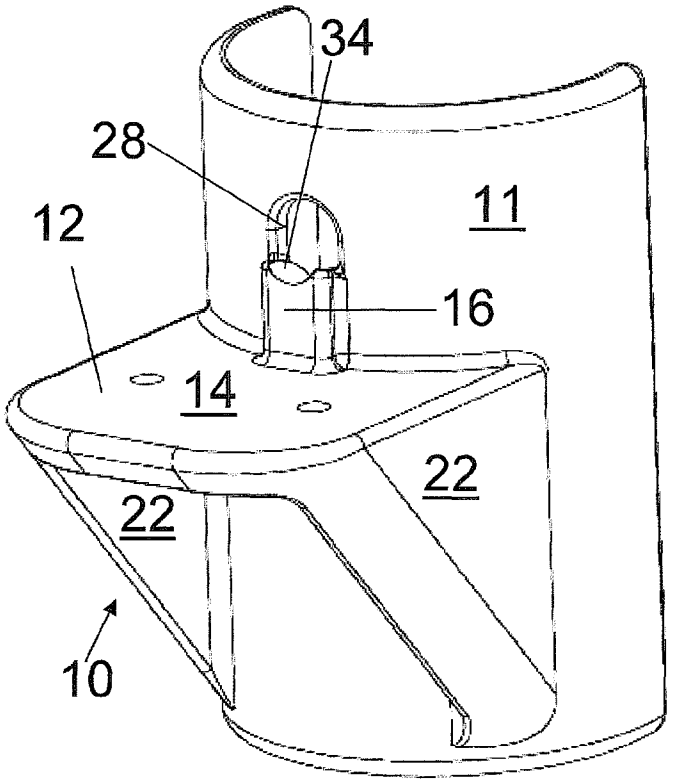
FIG. 1 shows a front perspective view of a cleat deck according to the present invention.
Figure 5:
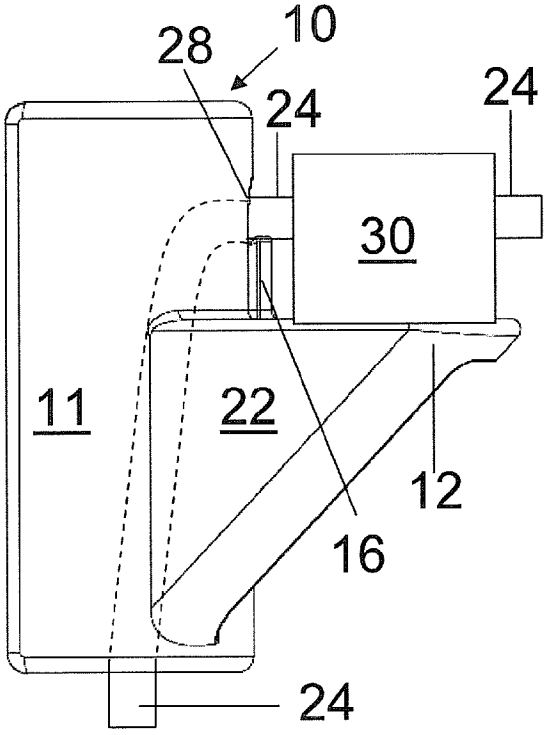
FIG. 5 shows a side elevational view of the cleat deck of FIG. 1.
Figure 4:
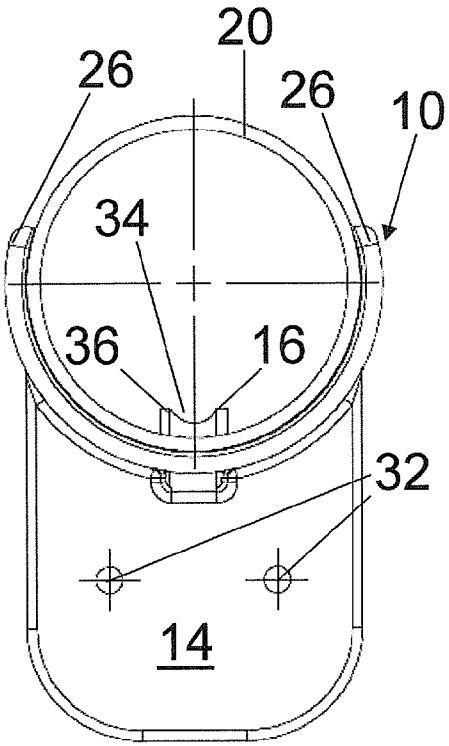
FIG. 4 shows a top plan view of the cleat deck and mast/tubular body of FIG. 3.
Figure 3:
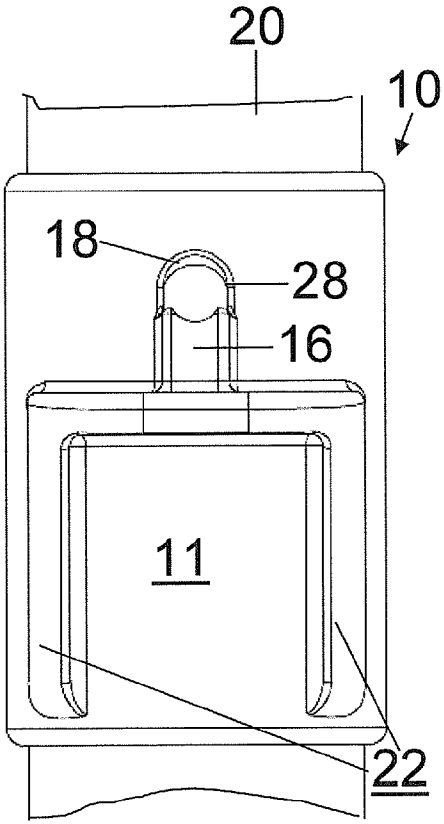
FIG. 3 shows a front elevational view of the cleat deck of FIG. 1 mounted to a mast/tubular body.

FIGS. 1-5 show a halyard cleat deck 10 having a body 11 and a platform 12 attached to the body. Platform 12 includes a face 14, which can be horizontal or tilted. A fairlead 16, shaped like a section of a sheave to have a curved running surface 34 flanked by line retaining side walls 36, extends upward from the face 14 and backward from the face 14 into a slot 18 in mast/tubular body 20. The fairlead 16 provides a smooth running surface that positions, guides and supports a line 24 (FIG. 5) entering an interior of the mast 20 from the exterior (line 24 shown in phantom on the interior of the mast 20), and vice versa. The fairlead 16 thus prevents the line from running on the mast 20 itself or the slot 18 in the mast 20, preventing abrasion of the line 24 and protecting the line 24. The fairlead 16 extending into the slot 18 also positions the cleat deck 10 with respect to the mast 20, and therefore, the size and shape of the slot 18 can be configured to closely fit the fairlead 16 to accurately position the cleat deck 10 on the mast 20.

The cleat deck 10 can also include one or more brackets 22 that extend from the body 11 to the platform 12 to support and strengthen the platform 12. The brackets 22 can extend below the platform 12, as shown, or above the platform. The body 11 can be formed to closely fit an intended mast 20 and can be sized accordingly. In the embodiment shown, the body 11 includes two wings 26 that wrap more than 180° around the mast 20 to help clamp the cleat deck 10 to the mast 20. The cleat deck 10 can also be firmly attached to the mast with adhesive, threaded fasteners, additional clamps, by welding or by other known methods. The body 11 can extend upward beyond the fairlead 16, in which case a slot 28 is provided in the body 11 for passing the line 24 into the interior of the mast 20. The fairlead 16 can also be separated from the face 14, as well as attached to the body 11 above the slot 28, in which case, the line could be routed upward with respect to the cleat deck 10. The body 11 can also vertically stop at the face 14, except for the fairlead 16. The cleat deck can be mounted on the mast 20 as shown, in a position where the face 14 faces upward, in a reversed position where the face 14 faces downward, or even in a sideways orientation on a tubular body having a horizontal element to its orientation. In the latter two cases, the above position and orientation descriptions would be relative.

The entire cleat deck 10 can be molded from low friction smooth plastic or from another material. A jam cleat 30 (FIG. 5) or other type of cleat can be fastened to the platform 12 to hold the line 24 in the desired position. The jam cleat 30 can be attached to the platform 12 with threaded fasteners via holes 32 (FIG. 4) in platform 12, or in another manner. A height of the fairlead 16 can be configured to closely align with a height of the line 24 exiting the cleat 30. All dimensions can be varied as desired depending on the sizes of masts, lines and cleats that are desired to be used.

On a small boat with a lightly loaded halyard, it is thus possible to provide a single piece cleat deck without moving parts, which is strong, light weight, easily manufactured and functions well in such applications.

Various aspects of the different embodiments can be combined in different combinations to create new embodiments within the scope of the invention. The present invention is not limited to the disclosed embodiments.

COMPONENT NUMBERING

10 cleat deck
11 body
12 platform
14 face
16 fairlead
18 slot
20 mast/tubular body
22 bracket
24 line
26 wing
28 slot
30 jam cleat
32 hole
34 curved running surface
36 side wall

What is claimed is:

1. A cleat deck comprising:

a body for attachment to a tubular body;

a platform attached to the body and having a face for supporting a cleat; and a fairlead extending rearward of the body to extend into an interior of the tubular body, through a slot in the tubular body, the fairlead having a surface configured for guiding a line between an interior and an exterior of the tubular body.

2. The cleat deck of claim 1, wherein the fairlead is configured to closely fit the slot in the tubular body to position the cleat deck with respect to the tubular body.

3. The cleat deck of claim 2, and further comprising at least one bracket extending from the platform to the body for supporting the body.

4. The cleat deck of claim 3, wherein the body includes a pair of wings configured to extend more than 180° around the tubular body to clamp the cleat deck to the tubular body.

5. The cleat deck of claim 4, wherein the body extends above the fairlead and includes a slot positioned above the fairlead to allow passage of the line through the body.

6. The cleat deck of claim 5, wherein the cleat deck has a unitary molded construction and is made of plastic.

7. The cleat deck of claim 6, wherein the fairlead includes a curved running surface for the line flanked by two line retaining side walls and extends upward from the face.

8. The cleat deck of claim 1, and further comprising at least one bracket extending from the platform to the body for supporting the body.

9. The cleat deck of claim 8, wherein the body includes a pair of wings configured to extend more than 180° around the tubular body to clamp the cleat deck to the tubular body.

10. The cleat deck of claim 9, wherein the body extends above the fairlead and includes a slot positioned above the fairlead to allow passage of the line through the body.

11. The cleat deck of claim 10, wherein the cleat deck has unitary molded construction and is made of plastic.

12. The cleat deck of claim 11, wherein the fairlead includes a curved running surface for the line flanked by two line retaining side walls and extends upward from the face.

13. The cleat deck of claim 1, wherein the body includes a pair of wings configured to extend more than 180° around the tubular body to clamp the cleat deck to the tubular body.

14. The cleat deck of claim 13, wherein the body extends above the fairlead and includes a slot positioned above the fairlead to allow passage of the line through the body.

15. The cleat deck of claim 14, wherein the cleat deck has a unitary molded construction and is made of plastic.

16. The cleat deck of claim 15, wherein the fairlead includes a curved running surface for the line flanked by two line retaining side walls and extends upward from the face.

17. The cleat deck of claim 1, wherein the body extends above the fairlead and includes a slot positioned above the fairlead to allow passage of the line through the body.

18. The cleat deck of claim 17, wherein the cleat deck has a unitary molded construction and is made of plastic.

19. The cleat deck of claim 18, wherein the fairlead includes a curved running surface for the line flanked by two line retaining side walls and extends upward from the face.

20. The cleat deck of claim 1, wherein the fairlead includes a curved running surface for the line flanked by two line retaining side walls and extends upward from the face.

* * * * *